US011661717B2

(12) United States Patent
Ono et al.

(10) Patent No.: US 11,661,717 B2
(45) Date of Patent: May 30, 2023

(54) PILE PRESS-IN DEVICE AND PILE PRESS-IN METHOD

(71) Applicant: GIKEN LTD., Kochi (JP)

(72) Inventors: Masaaki Ono, Kochi (JP); Katsuhiko Ono, Kochi (JP); Yoshihiro Morioka, Kochi (JP); Kengo Nonaka, Kochi (JP)

(73) Assignee: GIKEN LTD., Kochi (JP)

( * ) Notice: Subject to any disclaimer, the term of this patent is extended or adjusted under 35 U.S.C. 154(b) by 0 days.

(21) Appl. No.: 17/433,343

(22) PCT Filed: Feb. 19, 2020

(86) PCT No.: PCT/JP2020/006508
§ 371 (c)(1),
(2) Date: Aug. 24, 2021

(87) PCT Pub. No.: WO2020/175269
PCT Pub. Date: Sep. 3, 2020

(65) Prior Publication Data

US 2022/0042269 A1 Feb. 10, 2022

(30) Foreign Application Priority Data

Feb. 28, 2019 (JP) ..... JP2019-035736

(51) Int. Cl.
*E02D 7/22* (2006.01)
*E02D 7/14* (2006.01)

(52) U.S. Cl.
CPC ..... *E02D 7/22* (2013.01); *E02D 7/14* (2013.01)

(58) Field of Classification Search
CPC .... E02D 7/22; E02D 7/14; E02D 7/20; E02D 7/26
See application file for complete search history.

(56) References Cited

U.S. PATENT DOCUMENTS

2003/0044241 A1* 3/2003 Mure ..... E02D 5/36 405/231
2004/0261571 A1 12/2004 Fukuchi
(Continued)

FOREIGN PATENT DOCUMENTS

CL 2013000652 A1 11/2013
CN 1540171 A 10/2004
(Continued)

OTHER PUBLICATIONS

Examination report issued in corresponding Australian Patent Application No. 2020229639 dated Mar. 18, 2022 (5 pages).
(Continued)

*Primary Examiner* — Carib A Oquendo
(74) *Attorney, Agent, or Firm* — Osha Bergman Watanabe & Burton LLP

(57) ABSTRACT

Provided are a pile press-in device and a pile press-in method that allow an efficient construction even when electrically powered devices and hydraulic devices coexist in order to give drive members a driving force. A pile press-in device (1) comprises a chuck (5) for gripping and rotating a pile (4) in order to press the pile (4) into a ground while rotating the pile (4). The pile press-in device (1) causes electric motors (6) corresponding to the electrically powered device of the invention to give the chuck (5) a driving force for the rotation. The chuck (5) is moved up and down by lift cylinders (7) which are hydraulically powered hydraulic devices. An integrated control board (50) controls the electric motors (6) and the lift cylinders (7) in an interlocked manner.

13 Claims, 9 Drawing Sheets

(56) References Cited

U.S. PATENT DOCUMENTS

| | | | | |
|---|---|---|---|---|
| 2006/0198706 | A1* | 9/2006 | Neville | E02D 5/56 405/252.1 |
| 2011/0064526 | A1 | 3/2011 | White | |
| 2016/0362864 | A1* | 12/2016 | Thurner | E02D 5/28 |
| 2019/0162211 | A1* | 5/2019 | Lyytikäinen | G05B 13/00 |
| 2020/0149241 | A1* | 5/2020 | Flanigan | F24S 25/617 |

FOREIGN PATENT DOCUMENTS

| | | | | |
|---|---|---|---|---|
| CN | 104452761 | A | 3/2015 | |
| CN | 106149714 | A | 11/2016 | |
| CN | 207582463 | U | 7/2018 | |
| EP | 1806455 | A1 | 7/2007 | |
| JP | H08-35226 | A | 2/1996 | |
| JP | H10-140554 | A | 5/1998 | |
| JP | 2000-273864 | A | 10/2000 | |
| JP | 2003213686 | A | 7/2003 | |
| JP | 2005-68691 | A | 3/2005 | |
| JP | 2005054404 | A | 3/2005 | |
| JP | 2006194004 | A | 7/2006 | |
| JP | 2012052299 | A | 3/2012 | |
| JP | 2012-162905 | A | 8/2012 | |
| JP | 5775899 | B2 | 9/2015 | |
| JP | 2018-204185 | A | 12/2018 | |
| JP | 2018-204278 | A | 12/2018 | |
| WO | WO-2012074381 | A2 * | 6/2012 | E02D 7/18 |

OTHER PUBLICATIONS

International Search Report issued in corresponding International Application No. PCT/JP2020/006508 dated May 12, 2020 (5 pages).
Singaporean Examination/Search Report and Notice of Eligibility for Grant issued in corresponding Singaporean Patent Application 11202109254P dated Apr. 7, 2022 (9 pages).
Office Action issued in counterpart Korean Patent Application No. KR 10-2021-7027379 dated May 25, 2022 (4 pages).
Chinese Office Action with translation dated Mar. 29, 2022, issued for Chinese Patent Application No. 202080017101.3 (20 pages).
Office Action issued in counterpart Chilean Patent Application No. CL 02207-2021 dated Jul. 8, 2022 (17 pages).
Office Action issued in counterpart Korean Patent Application No. KR 10-2021-7027379, dated Sep. 21, 2022 (8 pages).
Extended European Search Report issued in corresponding European Patent Application No. 20762809.0, dated Oct. 27, 2022 (5 pages).

* cited by examiner

PILE PRESS-IN DEVICE AND PILE PRESS-IN METHOD

CROSS-REFERENCE TO RELATED APPLICATIONS

This application claims the benefit of Japanese Patent Application No. 2019-035736 filed on Feb. 28, 2019 in Japan, the contents of which are incorporated herein by reference.

TECHNICAL FIELD

The present invention relates to a pile press-in device and a pile press-in method.

BACKGROUND ART

Pile press-in devices for pressing a pile into the ground while rotating the pile rotate a chuck gripping the pile and move the chuck up and down using hydraulic drive devices including hydraulic motors and lift cylinders, hydraulic pressure generators (hydraulic pumps) for supplying a hydraulic fluid to those hydraulic drive devices, and other hydraulic devices.

FIG. 9 is a diagram of a conventional configuration of a pile press-in system 100 in a state where hydraulic motors rotate a chuck 101 at high power.

If the power to rotate the chuck 101 of a pile press-in device 102 requires to be enhanced in the conventional pile press-in system 100, it would be required to increase the number of hydraulic motors that give the chuck 101 the driving force. In consequence, the number of power units 103 (hydraulic units) for supplying a hydraulic fluid to the hydraulic motors would be also increased according to the increase in the number of hydraulic motors. Power units 103A in FIG. 9 are increased power units 103.

The increase in the number of the power units 103 makes it difficult to place the increased power units 103 on completed piles, and may reduce workability. Placing the power units 103 away from the pile press-in device 102 would make it impossible to ignore the effect of a decrease in the pressure of the hydraulic fluid due to pressure loss.

In this regard, Patent document 1 discloses driving a chuck with an electric motor. Using an electric motor instead of a hydraulic motor for giving the chuck a driving force facilitates the enhancement of the output power, and eliminates the requirement of increasing the power units 103 mentioned above. Additionally, the electric motorization has the advantage of not causing problems including pressure loss in and a leak of a hydraulic fluid.

PRIOR ART DOCUMENT

Patent Document

Patent document 1: Japanese Patent Laid-Open Application No. Hei 08-035226

SUMMARY OF THE INVENTION

Problems to be Solved by the Invention

Such replacement of a part of hydraulic devices for driving the chuck or other drive members with electrically powered devices as disclosed in Patent document 1 would cause the coexistence of electrically powered devices and hydraulic devices in the pile press-in device. Construction work even with such a pile press-in device in which electrically powered devices and hydraulic devices coexist requires to be executed with the same efficiency as conventional pile press-in devices in which electrically powered devices and hydraulic devices do not coexist.

A purpose of the invention made in view of the above is to provide a pile press-in device and a pile press-in method that allow an efficient construction even when electrically powered devices and hydraulic devices coexist in order to give drive members a driving force.

Means for Solving the Problems

A pile press-in device of the invention is for pressing a pile into a ground while rotating the pile, and the pile press-in device comprises: a rotation device for gripping and rotating the pile; an electrically powered device for acting on the rotation device to give the rotation device a driving force for the rotation; a hydraulic device as a lift for moving the rotation device up and down; and a controller for controlling the electrically powered device and the hydraulic device in an interlocked manner.

In this configuration, the electrically powered device gives a driving force to the rotation device for gripping and rotating the pile, and the hydraulic device serves as the lift for moving the rotation device up and down. The configuration allows the electrically powered device and the hydraulic device to be optimally controlled by controlling them in an interlocked manner, therefore allowing an efficient construction even when the electrically powered device and the hydraulic device coexist in order to give drive members a driving force.

In the pile press-in device of the invention, the controller may control the up-and-down movement of the rotation device caused by the lift, based on a rotation output of the electrically powered device at a time of press-in of the pile gripped by the rotation device. Since the rotation output of the electrically powered device reflects information on the ground into which the pile is pressed (ground information), this configuration allows an efficient construction by controlling the up-and-down movement of the rotation device caused by the lift based on the rotation output of the electrically powered device.

In the pile press-in device of the invention, the rotation output may be calculated based on an inverter command issued to the electrically powered device. This configuration allows easy grasping of the rotation output of the electrically powered device, that is to say, the ground information.

In the pile press-in device of the invention, the controller may cause the lift to stop lowering the rotation device when the rotation output of the electrically powered device reaches a prescribed value. This configuration can prevent the toe of the pile from breakage due to an excessive ground resistance.

In the pile press-in device of the invention, the controller may control the rotation output of the electrically powered device according to a load condition of the electrically powered device. This configuration allows, for example, rotation torque to be increased according to the load condition of the electrically powered device, and therefore allows an efficient construction.

The pile press-in device of the invention may comprise a cooling device for cooling the electrically powered device. This configuration can prevent the electrically powered device from overheating.

In the pile press-in device of the invention, the cooling device may be a fan directly coupled to a rotating shaft of the electrically powered device. This configuration allows the electrically powered device to be cooled with a simple configuration.

In the pile press-in device of the invention, the cooling device may be a fan provided independently of a rotating shaft of the electrically powered device, and the controller may control a cooling capacity of the fan according to a rotation output or a load condition of the electrically powered device. This configuration allows the electrically powered device to be cooled efficiently.

In the pile press-in device of the invention, the cooling device may be cooling piping through which coolant circulates, and the coolant may cool a speed reducer coupled to a rotating shaft of the electrically powered device after cooling the electrically powered device. Since speed reducers are more tolerant of temperature rise than electrically powered devices, this configuration allows the electrically powered device and the speed reducer to be cooled efficiently.

In the pile press-in device of the invention, the controller may control a cooling capacity of the coolant according to a rotation output or a load condition of the electrically powered device. This configuration allows the electrically powered device to be cooled efficiently.

The pile press-in device of the invention may comprise a mast for supporting the lift so that the lift can relatively move in a vertical direction, where the mast is mounted with a tying member for tying together the cooling piping through which the coolant circulates and hydraulic piping through which a hydraulic fluid is supplied to the hydraulic device. A configuration in which the electrically powered device drives the rotation device may sometimes be replaced with a configuration in which the hydraulic device drives the rotation device depending on the ground conditions. This configuration allows the tying member to tie the cooling piping and the hydraulic piping together, and thereby allows an efficient replacement work.

In the pile press-in device of the invention, the coolant may double as water to be discharged from a toe of the pile when the pile is pressed into the ground. This configuration allows efficient use of the coolant.

In the pile press-in device of the invention, a hydraulic pressure generator for supplying the hydraulic fluid to the hydraulic device may be driven by an electrically powered device. Internal combustion engines are used as drive devices for hydraulic pressure generators in conventional pile press-in devices. This configuration, in which the electrically powered device driven by a commercial power supply is used instead of those internal combustion engines, can therefore reduce the environmental load.

A pile press-in device of the invention may be for using an electrically powered device to drive a part of a plurality of drive members and using a hydraulic device to drive the other drive members, and may comprise a controller for controlling the electrically powered device and the hydraulic device according to a driving condition of the drive members. For example, one of the drive members is a hydraulic pump for supplying a hydraulic fluid to a hydraulic cylinder, and the electrically powered device is an electric motor for driving the hydraulic pump. The electrically powered device is also an electric motor for rotating a chuck as one of the drive members. If one of the drive members is a hydraulic cylinder, the hydraulic device for driving this is a hydraulic pump. This configuration allows an efficient construction even when the electrically powered device and the hydraulic device coexist in order to give the drive members a driving force.

A pile press-in method of the invention may use a pile press-in device, the pile press-in device comprising: a rotation device for gripping and rotating a pile; a lift for moving the rotation device up and down; an electrically powered device for acting on the rotation device to give the rotation device a driving force for the rotation; and a hydraulic device as the lift for moving the rotation device up and down, the pile press-in method comprising: controlling the electrically powered device and the hydraulic device in an interlocked manner when a pile is pressed into a ground while being rotated. This configuration allows an efficient construction even when the electrically powered device and the hydraulic device coexist in order to give drive members a driving force.

Advantage of the Invention

The invention allows an efficient construction even when electrically powered devices and hydraulic devices coexist in order to give drive members a driving force.

BRIEF DESCRIPTION OF THE DRAWINGS

FIG. 6A shows a rotational characteristic of hydraulic motors and FIG. 6B shows a rotational characteristic of electric motors;

MODES OF EMBODYING THE INVENTION

An embodiment of the invention will now be described with reference to the drawings. The embodiment described below is merely illustrative of ways to implement the invention, and does not limit the invention to the specific configurations described below. When the invention is to be implemented, any specific configuration may be appropriately adopted according to the mode of implementation. A pile press-in device of the embodiment utilizes a reaction force from piles whose construction work has been completed (completed piles) and presses piles in one after another while self-moving on top of the completed piles. This construction method enables press-in work to be executed in hard ground and underground structures including concrete structures and does not require temporary working platforms, therefore allowing a shortening of work periods and an environmentally friendly construction.

Figure 1:
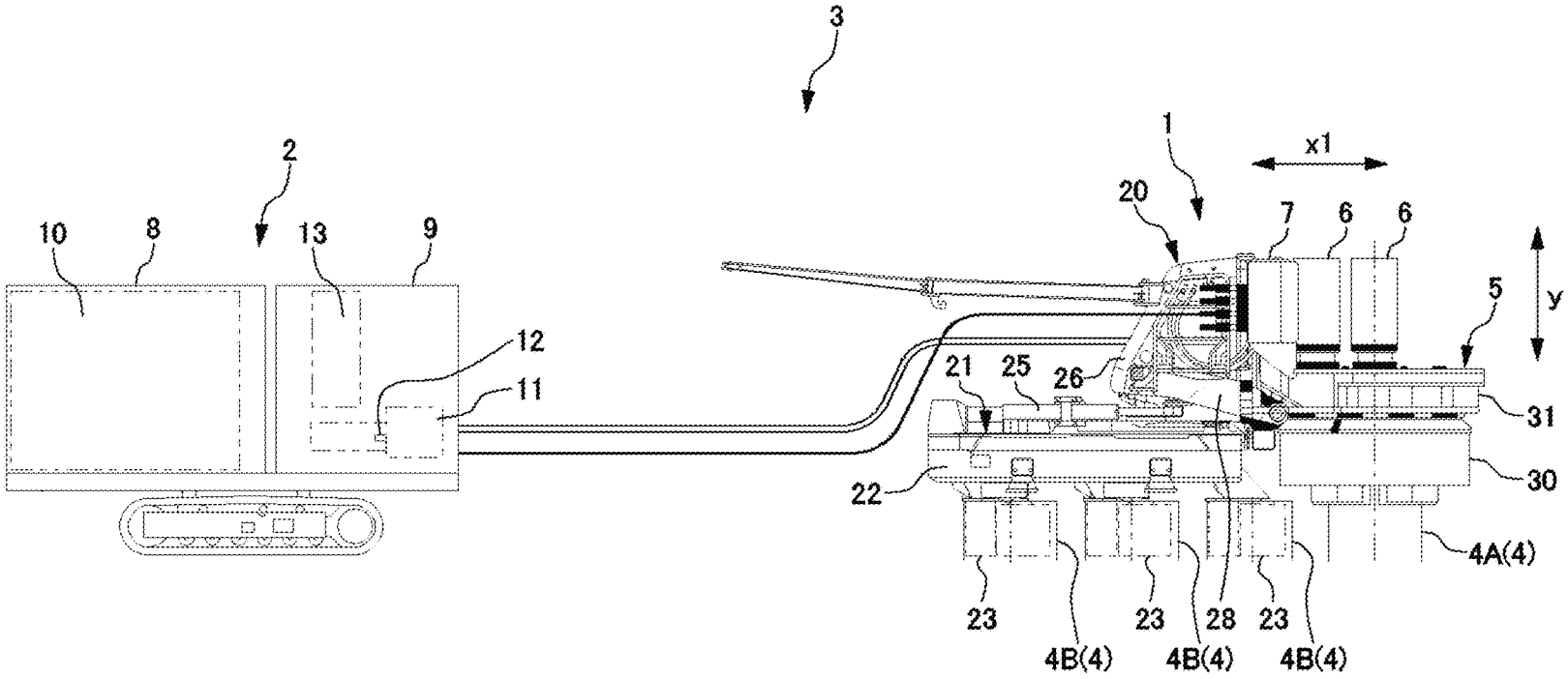
FIG. 1 is an external view of a pile press-in system of an embodiment.

FIG. 1 is a side view showing a general configuration of a pile press-in system 3 comprising a pile press-in device 1 and a power unit 2 of the embodiment.

The pile press-in device 1 of the embodiment comprises a chuck 5 for gripping and rotating a pile 4 in order to press the pile 4 into the ground while rotating it. The chuck 5 corresponds to the rotation device of the invention. The chuck 5 of the embodiment is given a driving force for the rotation by electric motors 6 corresponding to the electrically powered device of the invention. The electric motors 6 are controlled, for example, by an inverter, and their rotation output (rotation torque and rotation speed) is controlled by controlling at least one of the frequency, voltage, and current of supplied electricity.

The chuck 5 is moved up and down by lift cylinders 7. The lift cylinders 7 correspond to the lift of the invention, and are hydraulically powered hydraulic devices (hydraulic drive devices).

The power unit 2 of the embodiment comprises a control unit 8 for controlling the electric motors 6, and an electrohydraulic unit 9 for supplying a hydraulic fluid to hydraulic devices including the lift cylinders 7. The control unit 8 comprises an inverter 10 for controlling the rotation torque and the like of the electric motors 6. The electrohydraulic unit 9 comprises a hydraulic pump 11 (hydraulic pressure generator) for supplying the hydraulic fluid to hydraulic devices including the lift cylinders 7, and the hydraulic pump 11 is driven by an electric motor 12. The hydraulic fluid is stored in a hydraulic fluid tank 13 comprised in the electrohydraulic unit 9.

The electric motors 6 and 12 comprised in the pile press-in system 3 are all powered by a commercial power supply through power cables.

In this regard, a conventional pile press-in system 3 would use an internal combustion engine (so-called engine) as a device for driving the hydraulic pump 11, but this would cause a burden on the environment since internal combustion engines generate exhaust gases. The power unit 2 of the embodiment, on the other hand, uses an electrically powered device, the electric motor 12, instead of an internal combustion engine as described above, therefore generates no exhaust gas and can reduce the environmental load.

Additionally, since the chuck 5 is driven by the electric motors 6, only a small capacity is required for the hydraulic fluid tank 13, in which the hydraulic fluid is stored, of the power unit 2 of the embodiment as compared to when the chuck 5 is driven by hydraulic motors. The electric motor 12 is smaller and lighter than an internal combustion engine. The power unit 2 of the embodiment can therefore be downsized as compared to conventional ones.

Figure 9:
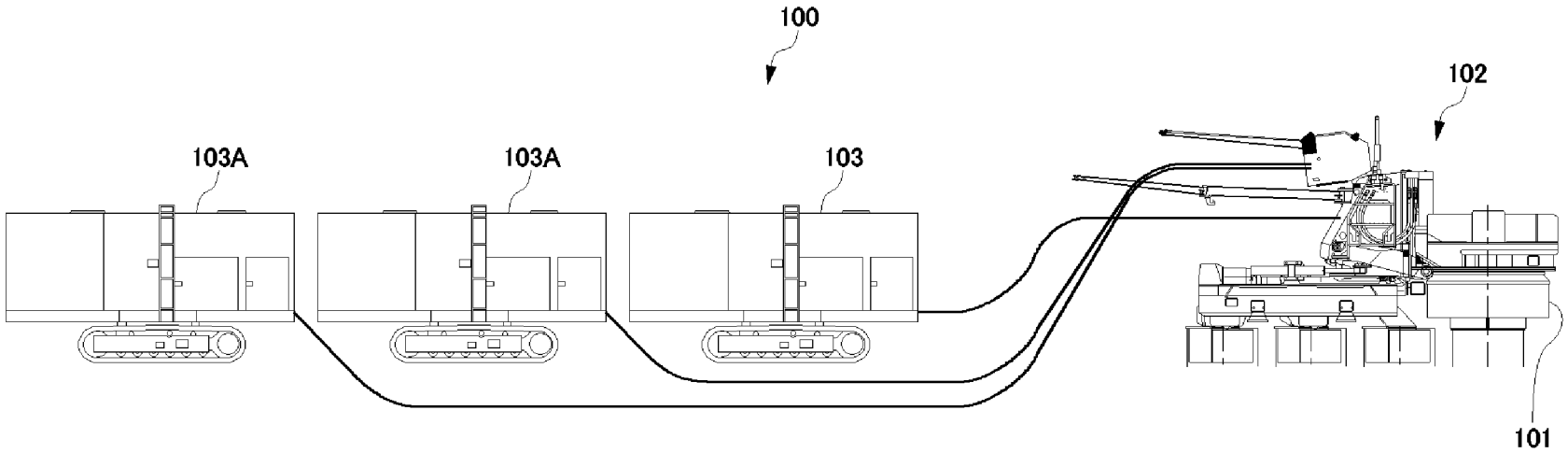
FIG. 9 is an external view of a conventional pile press-in system.

Furthermore, using the electric motors 6 as a device for driving the chuck 5 allows the rotation output of the chuck 5 to be enhanced electrically as described later. That is to say, when the chuck 5 were driven by hydraulic motors and if the output power of the chuck 5 were to be enhanced, the power unit 2 for supplying the hydraulic fluid to the hydraulic motors would require to be increased in number as well as the number of the hydraulic motors (see FIG. 9). Using the electric motors 6 as a device for driving the chuck 5 as with the pile press-in system 3 of the embodiment, on the other hand, allows the rotation output of the chuck 5 to be enhanced without increasing the power unit 2 in number.

As described above, the pile press-in device 1 (pile press-in system 3) of the embodiment uses electrically powered devices to drive a part of a plurality of drive members and uses a hydraulic device to drive the other drive members. That is to say, if one of the drive members is the chuck 5, the electrically powered devices are the electric motors 6 for rotating the chuck 5, in the pile press-in device 1 of the embodiment. If the other drive members are the lift cylinders 7, the hydraulic device for driving these is the hydraulic pump 11. If one of the drive members is the hydraulic pump 11 comprised in the power unit 2, one of the electrically powered devices is the electric motor 12 for driving the hydraulic pump 11, in the pile press-in system 3 of the embodiment.

Figure 2:
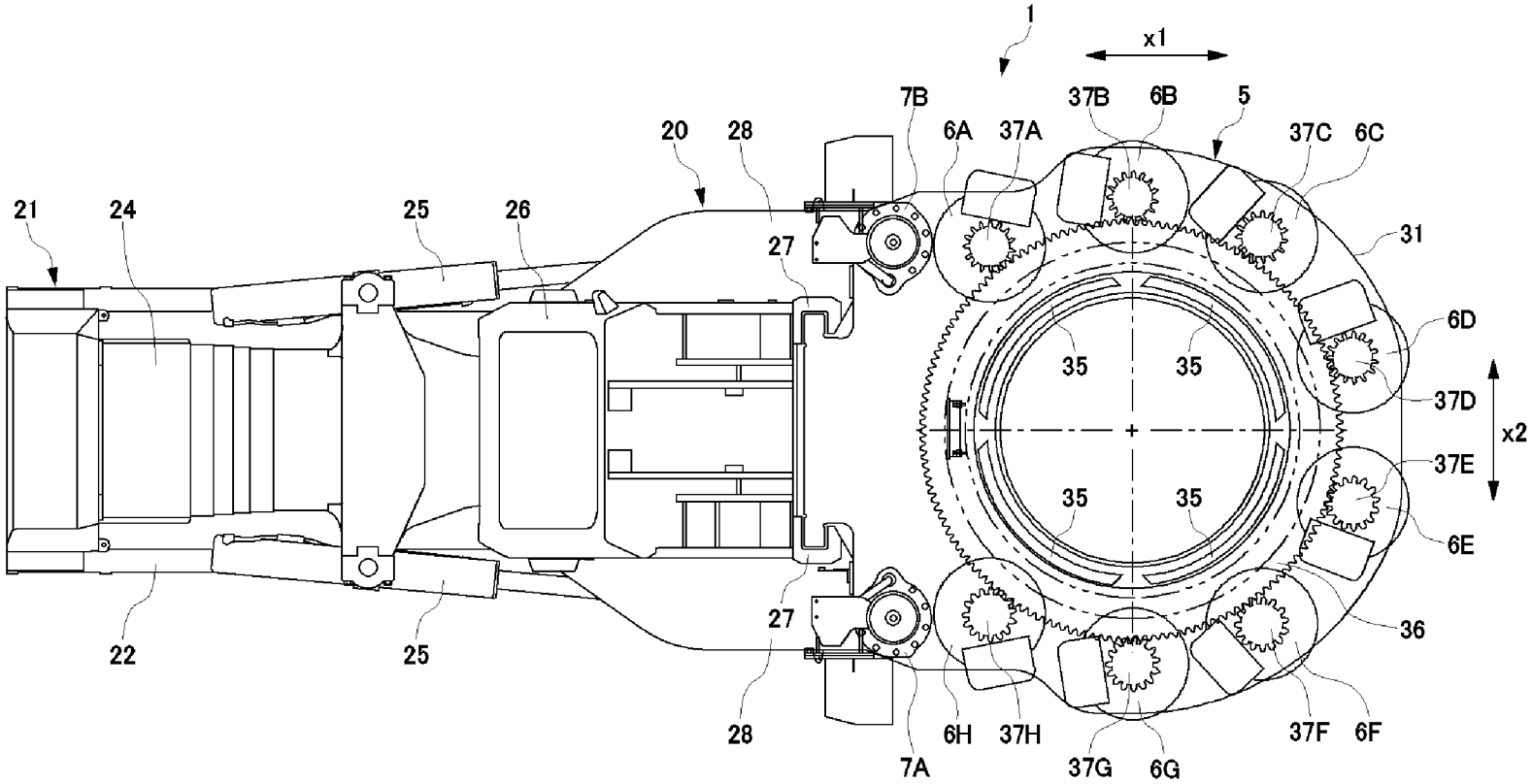
FIG. 2 is a configuration diagram of the pile press-in system of the embodiment seen from above.

Now, the configuration of the pile press-in device 1 of the embodiment will be described in detail also with reference to FIG. 2. FIG. 2 is a top view of the pile press-in device 1 shown in FIG. 1 seen from above.

As mentioned above, the pile press-in device 1 utilizes a reaction force from completed piles 4B (reaction piles) to press a press-in pile 4A made of a steel pipe of a prescribed length in a prescribed place (see FIG. 1). The pile press-in device 1 is used, for example, for bank protection works and retaining wall works in which a plurality of piles 4, 4, . . . are arranged and installed in one direction. The press-in pile 4A to be pressed in by the pile press-in device 1 is suspended by a crane (not shown in the figures) movably placed near the pile press-in device 1. In the following description about the pile 4, a pile to be pressed in by the pile press-in device 1 is referred to as a press-in pile with a symbol 4A, a previously installed pile is referred to as a completed pile with a symbol 4B, and a completed pile 4B gripped by a later-described cramp 23 is referred to as a reaction pile.

The pile press-in device 1 comprises the chuck 5 for removably gripping a circular-tube-shaped press-in pile 4A, a mast 20 for supporting the chuck 5 so that the chuck 5 can relatively move in a vertical direction y, and a saddle 21 for supporting the mast 20 so that the mast 20 can relatively move in a back-and-forth direction x1. The pile press-in device 1 moves (self-moves) on arranged completed piles 4B along the direction of the arrangement using a movement of the mast 20. The power unit 2 moves on the completed piles 4B with the pile press-in device 1.

The saddle 21 has a saddle body 22, and a plurality of (three, in the example of FIG. 1) cramps 23 drooping from the saddle body 22. Each cramp 23 is configured to be inserted inside a top end of a completed pile 4B to hold and release the completed pile 4B from the inside using a hydraulic cylinder not shown in the figures.

The mast 20 comprises a plate-like slide frame 24 mounted on the saddle body 22, a mast base 26 mounted on the slide frame 24 via a rotator 25, and vertical rails 27 mounted on the front end of the mast base 26. The mast base 26 is pivotally mounted around the rotation axis of the rotator 25, the rotation axis extending in the vertical direction y.

The vertical rails 27 extend in the vertical direction y. The chuck 5 is fitted to the vertical rails 27 on the front side so as to be able to move up and down. The bottom end of the mast 20 is mounted with mast arms 28 and 28 each protruding forward from each end of the mast 20 extending in a right-and-left direction x2.

The chuck 5 comprises a chuck body 30 (see FIG. 1), and a chuck frame 31 for rotatably supporting the chuck body 30. As shown in FIG. 2, the chuck body 30 has an insertion hole through which the press-in pile 4A can be inserted in the vertical direction y. The chuck frame 31 is mounted with a pair of lift cylinders 7 (7A and 7B), the front ends of which are each fixed to each of the pair of mast arms 28 of the mast 20. The chuck frame 31 fits to the vertical rails 27 so as to be made slidable in the vertical direction y along the vertical rails 27 by the extension and retraction of the lift cylinders 7.

The pair of lift cylinders 7 are placed with the direction of extension and retraction of their rods being parallel to the vertical direction y, and the tips of their rods are fixed to the protruding ends of the mast arms 28. Retracting the rods of the lift cylinders 7 in an extended state therefore moves the chuck frame 31 and the chuck body 30 downward by way of the lift cylinders 7, allowing the press-in pile 4A gripped by the chuck body 30 to move downward in the press-in direction. The lift cylinders 7 thus act on the chuck body 30 via the chuck frame 31 and give the chuck body 30 a propulsive driving force for pressing the press-in pile 4A in. A stroke sensor for detecting the stroke of the press-in pile 4A (not shown in the figures) is provided inside the chuck frame 31.

As shown in FIG. 2, the chuck body 30 is a part that is rotatably supported inside the chuck frame 31 and grips the press-in pile 4A. The chuck body 30 is provided with a plurality of chuck jaws 35 inside thereof. The chuck body 30 grips the press-in pile 4A by the chuck jaws 35 pressing the press-in pile 4A from outside the outer periphery, and rotates with respect to the chuck frame 31.

A chuck rotation gear 36 is fixed to the outer periphery of the chuck body 30. Around the chuck rotation gear 36 are a plurality of (eight, in the example of FIG. 2) drive gears 37A to 37H rotatably supported by the chuck frame 31, and they are engaged with the chuck rotation gear 36. The drive gears 37A to 37H are rotated by electric motors 6A to 6H, respectively. The electric motors 6A to 6H are fixed to the chuck frame 31 above the drive gears 37A to 37H, respectively, and the drive gears 37A to 37H are rotatably fixed to the chuck frame 31 as well.

The drive gears 37A to 37H are hereinafter collectively referred to as the drive gears 37, and the electric motors 6A to 6H are hereinafter collectively referred to as the electric motors 6.

In the pile press-in device 1 thus configured, the electric motors 6 rotate the drive gears 37, which rotate the chuck body 30 via the chuck rotation gear 36, resulting in the rotation of the press-in pile 4A gripped by the chuck body 30. In this way, the electric motors 6 and the drive gears 37 act on the chuck body 30 via the chuck rotation gear 36 to give the chuck body 30 a rotational driving force for pressing the press-in pile 4A in.

Figure 3:
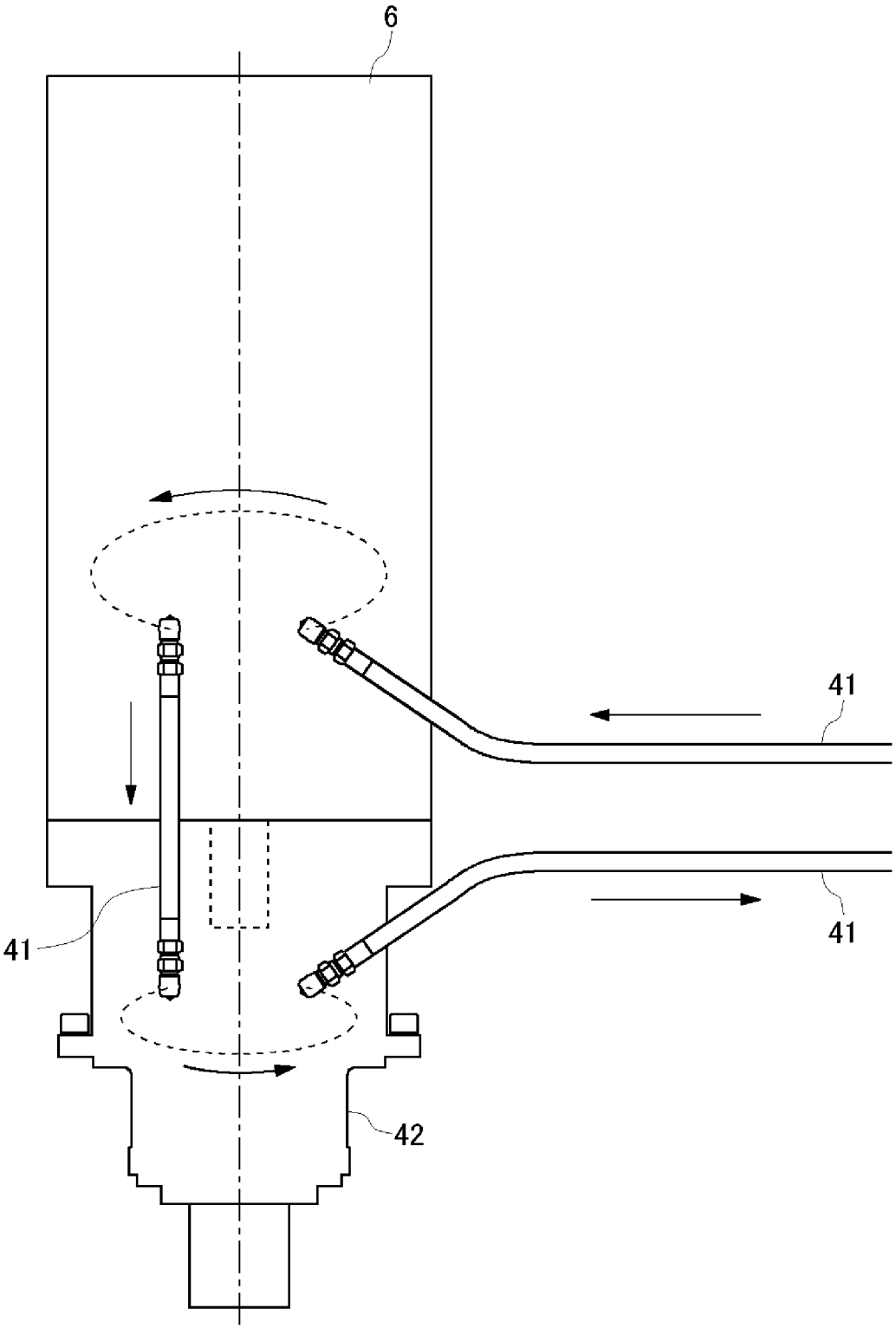
FIG. 3 is a schematic view showing cooling piping for cooling an electric motor of the embodiment.

The pile press-in device 1 of the embodiment comprises a cooling device for cooling the electric motors 6 to prevent them from overheating. The cooling device of the embodiment is cooling piping 41 as shown in FIG. 3, and the electric motors 6 are cooled by coolant which flows through the cooling piping 41 placed around the electric motors 6. An example of the coolant of the embodiment is water (hereinafter referred to as the "cooling water"), but the coolant is not limited to this and may be antifreeze and the like.

The cooling piping 41 cools the electric motors 6 and speed reducers 42 coupled to rotating shafts of the electric motors 6 with the cooling water. As indicated by arrows in FIG. 3, the cooling piping 41 of the embodiment is installed so that the cooling water cools the speed reducers 42 after cooling the electric motors 6. Since the speed reducers 42 are more tolerant of temperature rise than the electric motors 6, this configuration allows the electric motors 6 and the speed reducers 42 to be cooled efficiently.

A radiator for cooling the cooling water, an electric cooling pump for delivering the cooling water, and the like are, for example, installed at the site separately from the pile press-in device 1, and the cooling water is delivered from a large capacity tank installed at the site to the electric motors 6 and the speed reducers 42.

More specifically, the water (cooling water) in the large capacity tank is delivered by the electric cooling pump through piping mounted on the mast 20 and then through crossover piping between the mast 20 and the chuck 5 to a manifold block installed on top of the chuck 5 (hereinafter referred to as the "upstream manifold block"). The upstream manifold block has a relief function to protect the cooling piping 41. The piping then branches off at the upstream manifold block to the cooling piping 41 installed for each electric motor 6, so that the cooling water is delivered to each electric motor 6 and each speed reducer 42. After cooling each electric motor 6 and each speed reducer 42, the cooling water returns via a downstream manifold block and then through piping on the mast 20 to the large capacity tank.

The cooling water in the large capacity tank doubles as water to be discharged from a toe of the pile 4 when the pile 4 is pressed into the ground. This allows the pile press-in device 1 of the embodiment to use the cooling water efficiently.

Figure 4:
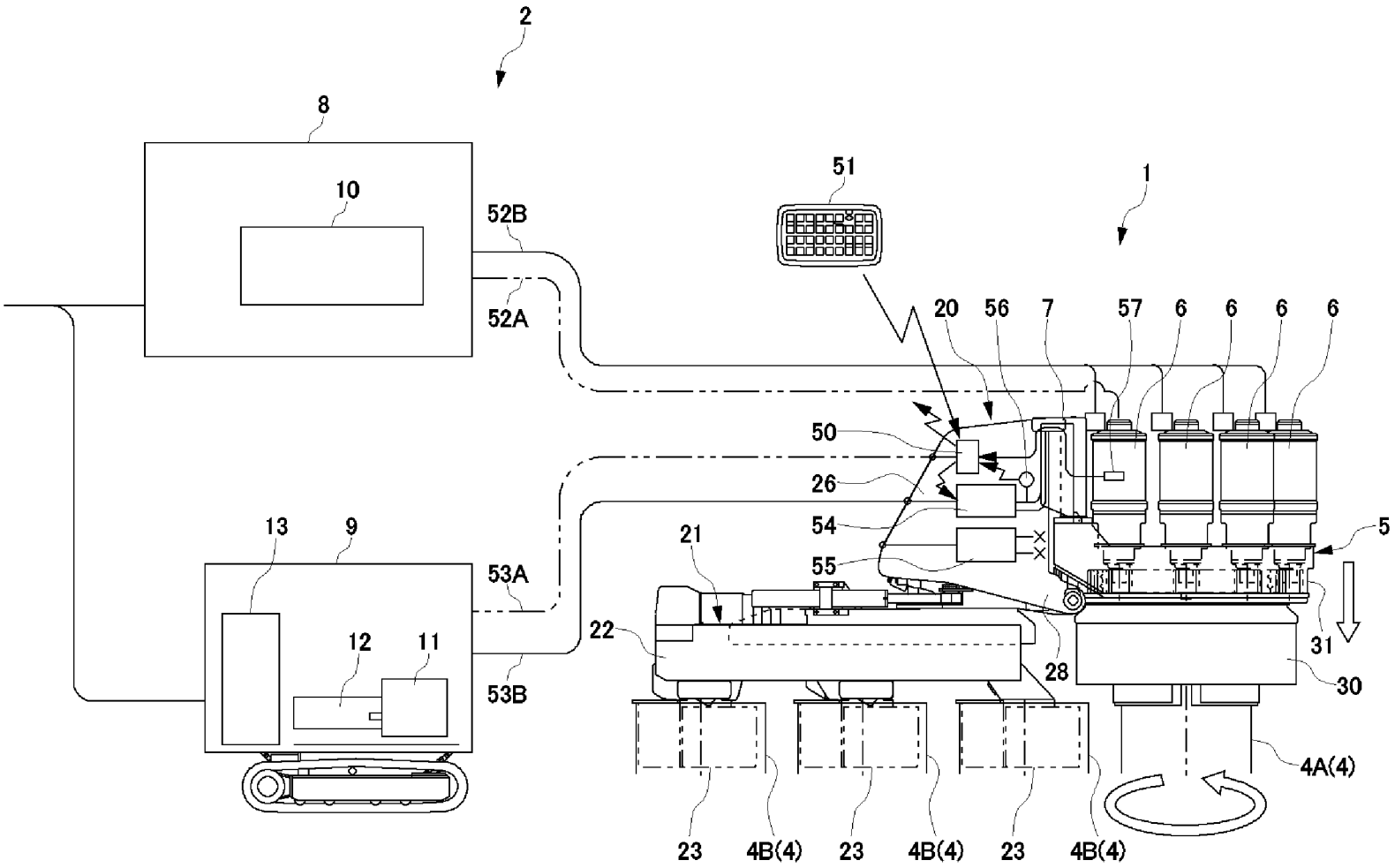
FIG. 4 is a schematic view showing a control system, an electric power system, and a hydraulic power system of the pile press-in system of the embodiment.

A detailed description of the control of the pile press-in device 1 will be given next. FIG. 4 is a schematic view showing a control system, an electric power system, and a hydraulic power system of the pile press-in system 3 of the embodiment.

The pile press-in device 1 comprises an integrated control board 50 for controlling the pile press-in system 3. The integrated control board 50 corresponds to the controller of the invention.

The integrated control board 50 of the embodiment is a device for controlling mainly the electric motors 6 (the electrically powered device) and the lift cylinders 7 (the hydraulic device) in an interlocked manner. This allows the pile press-in system 3 of the embodiment to optimally control the electrically powered device and the hydraulic device, therefore allowing an efficient construction even when the electrically powered device and the hydraulic device coexist in order to give drive members (for example, the chuck 5) a driving force.

The integrated control board 50 controls the pile press-in device 1 based on set values for a load and torque set by an operator using an operation panel 51. The operation panel 51 is held by an operator and wirelessly sends and receives information including the set values to and from the integrated control board 50.

The control unit 8 comprised in the power unit 2 and the integrated control board 50 are connected to each other via an electric power system control line 52A, through which information is inputted and outputted. The control unit 8 is also connected to the electric motors 6 via an electric power line 52B, and supplies electric power to the electric motors 6 using inverter control.

The electrohydraulic unit 9 comprised in the power unit 2 and the integrated control board 50 are connected to each other via a hydraulic system control line 53A, through which information is inputted and outputted. The electrohydraulic unit 9 is also connected to the mast 20 via a hydraulic supply line 53B, and supplies the hydraulic fluid to the mast 20.

The mast 20 is provided with a lift hydraulic control valve 54 and a rotation hydraulic control valve 55. The lift hydraulic control valve 54 and the rotation hydraulic control valve 55 are provided with ports for the hydraulic supply line 53B. The lift hydraulic control valve 54 and the rotation hydraulic control valve 55 are, for example, electromagnetic valves.

The lift hydraulic control valve 54 is opened and closed according to a control signal sent from the integrated control board 50 in order to control the supply of the hydraulic fluid from the electrohydraulic unit 9 to the lift cylinders 7. The rotation hydraulic control valve 55 of the embodiment, on the other hand, is not connected to the electrohydraulic unit 9. This is because the rotation hydraulic control valve 55 is to be used for hydraulic motors to drive the chuck 5 and the pile press-in device 1 of the embodiment does not have such hydraulic motors since the chuck 5 is driven by the electric motors 6.

The pile press-in system 3 is also provided with a fluid return line for returning the hydraulic fluid supplied from the electrohydraulic unit 9 to the hydraulic device of the pile press-in device 1 back to the electrohydraulic unit 9, and a leaking fluid return line for returning the hydraulic fluid that has leaked from the hydraulic device back to the electrohydraulic unit 9.

The pile press-in device 1 is provided with a status detector 56. The status detector 56 detects, for example, status data other than the rotation of the chuck 5 and sends it to the integrated control board 50. The status data includes, for example, the hydraulic pressure of the hydraulic fluid supplied to the lift cylinders 7, the machine attitude that indicates the attitude of the pile press-in device 1, and the cramp safety status that indicates how the completed piles 4B are gripped by the cramps 23.

The electric motors 6 are each provided with a temperature sensor 57 inside thereof, and send temperature information detected by their respective temperature sensor 57 to the integrated control board 50. The temperatures of the electric motors 6 vary, for example, depending on the load factor of the rotation output and torque. An example of the temperature sensors 57 is a resistance thermometer bulb, but they are not limited to this and may be thermocouples or other sensors. The integrated control board 50 monitors variations in the temperatures of the electric motors 6 in this manner and, based on the temperatures detected by the temperature sensors 57, detects eventualities including a failure of the electric motors 6 and a malfunction in the water cooling system.

Figure 5:
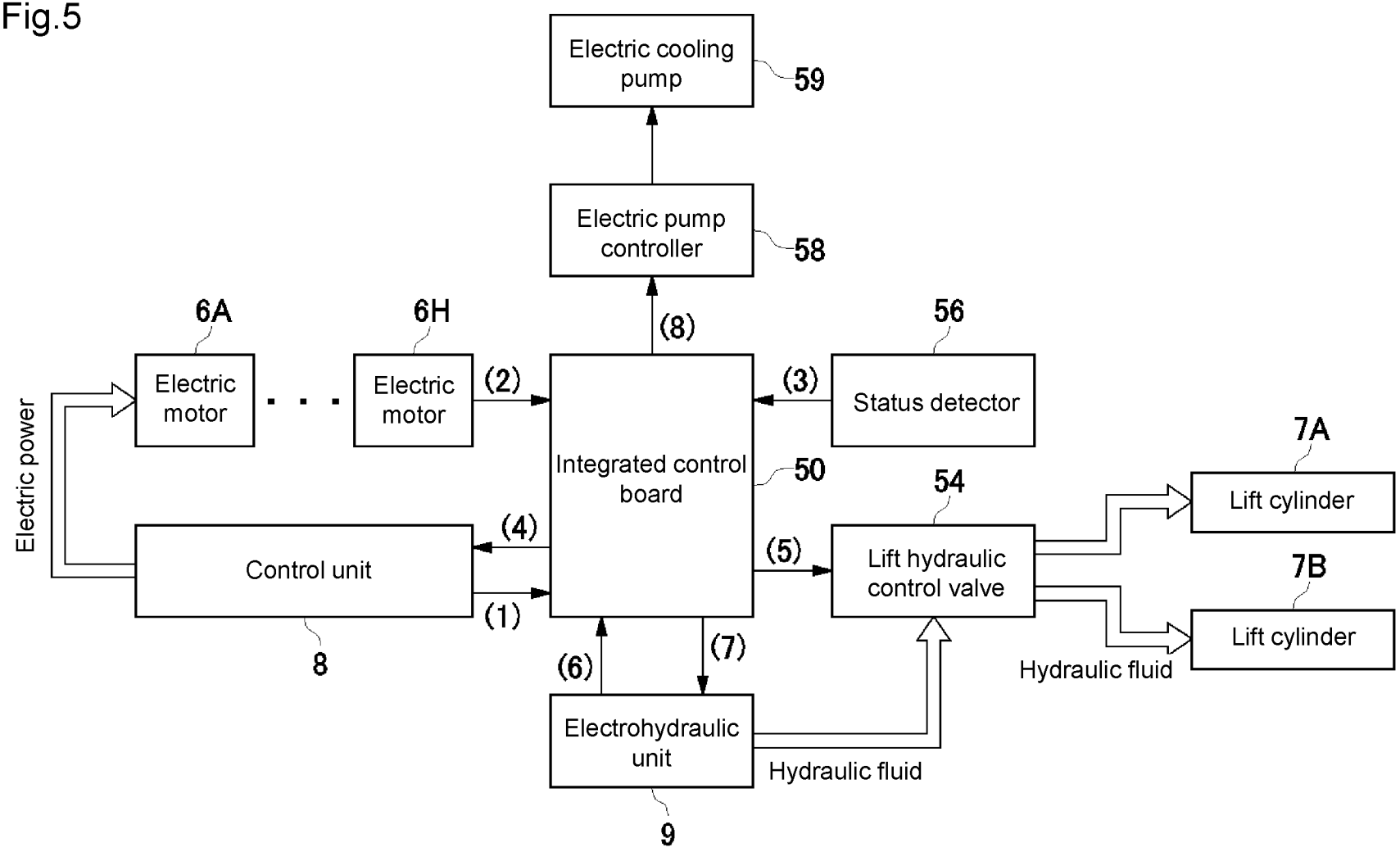
FIG. 5 is a block diagram showing the control system of the pile press-in system of the embodiment.

Next, the functions of the integrated control board 50 of the embodiment will be described in detail also with reference to FIG. 5. FIG. 5 is a block diagram showing the control system of the pile press-in system 3. Items (1) through (8) shown in FIG. 5 correspond to the following (1) through (8) listed about information inputted and outputted between components.

(1) From the control unit 8 to the integrated control board 50: Rotation output information of the electric motors 6 (a real-time output, the total torque value (the total value for the electric motors), an average value, abnormality monitoring information, the voltage values and the current values of the electric motors 6, or the like) is outputted.

(2) From the electric motors 6 to the integrated control board 50: Information on the temperatures of the electric motors 6 is outputted.

(3) From the status detector 56 to the integrated control board 50: The hydraulic pressure of the hydraulic fluid supplied to the lift cylinders 7, the machine attitude of the pile press-in device 1, the cramp safety status, or the like are outputted.

(4) From the integrated control board 50 to the control unit 8: A set torque (rotation torque signal) is calculated by the integrated control board 50 calculating the press-in load and the extraction load on the pile press-in device 1, and an inverter command is outputted to the control unit 8 based on the calculated set torque. The inverter command includes boosting, and stopping the electric motors.

(5) From the integrated control board 50 to the lift hydraulic control valve 54: A valve open-close signal. For example, a valve close signal is outputted if the rotation torque reaches a prescribed value or higher.

(6) From the electrohydraulic unit 9 to the integrated control board 50: A hydraulic fluid status signal that indicates the current pressure, the flow rate, or the like of the hydraulic fluid is outputted.

(7) From the integrated control board 50 to the electrohydraulic unit 9: A hydraulic fluid pressure control request signal is outputted. Upon receiving the signal, the electrohydraulic unit 9 controls the pressure and the flow rate of the hydraulic fluid.

(8) From the integrated control board 50 to an electric pump controller 58: A flow rate signal that indicates the flow rate of the cooling water is outputted based on information on the temperatures of the electric motors 6. The electric pump controller 58 controls an electric cooling pump 59 so that the cooling water is supplied at a flow rate based on the flow rate signal.

As shown in the items (1) through (8) listed above, pieces of information indicating the machine status of the pile press-in system 3 are inputted to the integrated control board 50, the pieces of information including the press-in load and the extraction load on the pile 4, the machine attitude, the cramp safety status, the temperatures of the electric motors 6, and the state of the hydraulic fluid. The integrated control board 50 then automatically controls the machine status so that values (the loads and the torque) arbitrarily set by an operator via the operation panel 51 are followed. The integrated control board 50 controls the loads by controlling the relief pressure of the electrohydraulic unit 9, and controls the torque by controlling the inverter command of the control unit 8. Signals including an error signal and a failure signal other than the data shown in the items (1) through (8) are also inputted and outputted between the components as required.

The various controls performed by the integrated control board 50 of the embodiment will be described in detail below.

The integrated control board 50 controls the up-and-down movement of the chuck 5 caused by the lift cylinders 7, based on the rotation output of the electric motors 6 at a time of press-in of the pile 4 gripped by the chuck 5. The control is performed in the embodiment based on the rotation torque, which is an example of the rotation output, but the control is not limited to this and may be performed based on the rotation speed or a combination of the rotation torque and the rotation speed. A downward movement of the chuck 5 caused by the lift cylinders 7 is triggered by a rotation of the chuck 5 in the embodiment. In other words, the lift cylinders 7 do not move the chuck 5 downward while the chuck 5 is not rotating. When the chuck 5 is not gripping the pile 4, the lift cylinders 7 is allowed to move the chuck 5 downward or upward to, for example, check the position of the chuck 5.

The calculation of the torque at a time of press-in of the pile 4 will be described next.

First, the rotation torque signal (the inverter command, i.e., set values for frequency and voltage) to be inputted from the integrated control board 50 to the control unit 8 corresponds to the total amount of force acting on the pile 4 from the ground. Secondly, the ratio between torque generated on the periphery of the pile 4 and torque generated on the toe of the pile 4 varies depending on ground conditions. This ratio of torque can be estimated, for example, by the difference between the rotation torque of the chuck 5 at a time of press-in of the pile 4 (hereinafter referred to as the "press-in-time rotation torque") and that at a time of extraction of the pile 4 (hereinafter referred to as the "extraction-time rotation torque"). The press-in-time rotation torque is the sum of the torque generated on the periphery of the pile 4 and the torque generated on the toe of the pile 4, and the extraction-time rotation torque is the torque generated on the periphery of the pile 4. Therefore, the torque generated on the toe of the pile 4 is calculated from the difference between the press-in-time rotation torque and the extraction-time rotation torque. Ground information for various depths in the ground is then obtained from the increase rate, the decrease rate, or the like of the torque generated on the toe of the pile 4.

As described above, the rotation output of the electric motors 6 reflects information on the ground into which the pile 4 is pressed. The pile press-in system 3 therefore allows an efficient construction by controlling the up-and-down movement of the chuck 5 caused by the lift cylinders 7 based on the rotation output of the electric motors 6. The pile press-in system 3 of the embodiment can estimate ground conditions by correlatively connecting actual measured values of the press-in force, the extraction force, and the rotation torque of the pile 4 together, allowing an automatic operation with an optimal up-and-down stroke and rotation output of the chuck 5.

The integrated control board 50 of the embodiment calculates the rotation output (rotation torque, in the embodiment) of the electric motors 6 based on the inverter command issued to the electric motors 6. This allows easy grasping of the rotation output of the electric motors 6, that is to say, the ground information.

In addition, the integrated control board 50 of the embodiment performs overload protection in which it causes the lift cylinders 7 to stop lowering the chuck 5 (hereinafter referred to as a "chuck lowering operation") when the rotation output of the electric motors 6 reaches a prescribed value.

The overload protection of the embodiment will be described specifically. An operator first sets an upper torque limit, which is an upper limit of the rotation torque, via the operation panel 51. The chuck 5 gripping the pile 4 is then lowered in the press-in direction by the lift cylinders 7. As the press-in force increases due to ground resistance to the toe of the pile 4 while the rotary press-in of the pile 4 is continued by the chuck lowering operation, the rotation torque of the electric motors 6 increases accordingly. The integrated control board 50 stops the lowering operation of the chuck 5, that is, the operation of the lift cylinders 7 if the rotation torque reaches the upper torque limit. This can prevent bits (claws) welded to the toe of the pile 4 from breakage due to an excessive ground resistance. The stopping of the operation of the lift cylinders 7 is performed by the integrated control board 50 outputting a valve close signal to the lift hydraulic control valve 54 and outputting a stop signal for the hydraulic pump 11 and the electric motor 12 to the electrohydraulic unit 9.

The integrated control board 50 of the embodiment controls the rotation output of the electric motors 6 according to a load condition of the electric motors 6. The load condition of the electric motors 6 is determined, for example, by the value of the current outputted from the inverter 10 to the electric motors 6 (the current value). More specifically, the load condition is the difference between the current value actually outputted to the electric motors 6 (hereinafter referred to as the "actual current value") and an upper limit current value determined in advance as an upper limit of the current value, and the load condition becomes heavier as the difference becomes smaller.

To be specific, by monitoring the load condition of the electric motors 6 in real time, the integrated control board 50 performs the control so as to temporarily and excessively increase a normal torque using inverter control (hereinafter referred to as "torque boost") to rotate the pile 4, and performs the control so as to restrain the torque according to the load condition. Torque boosting means boosting the torque to a rated value (100%) or higher within the output of the electric motors 6 (the product of the rotation speed and the torque value).

Figure 6:
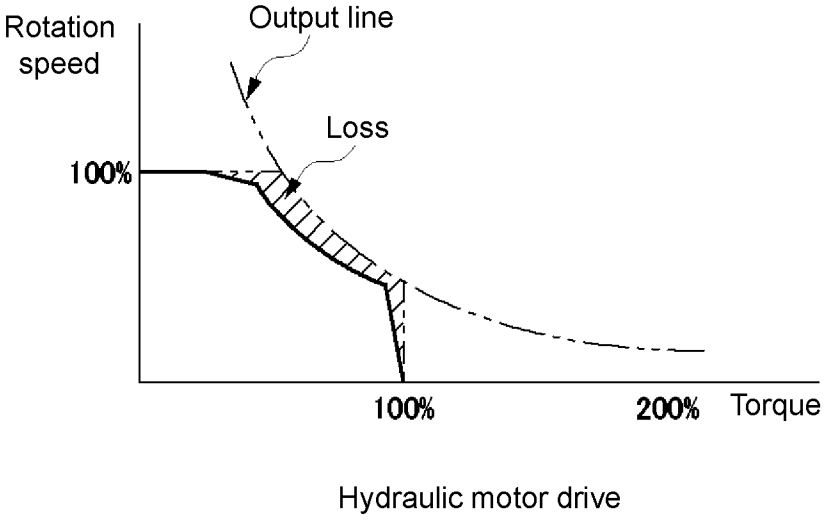
FIGS. 6A and 6B are graphs showing rotational characteristics of hydraulic motors and electric motors, where
Figure 6:
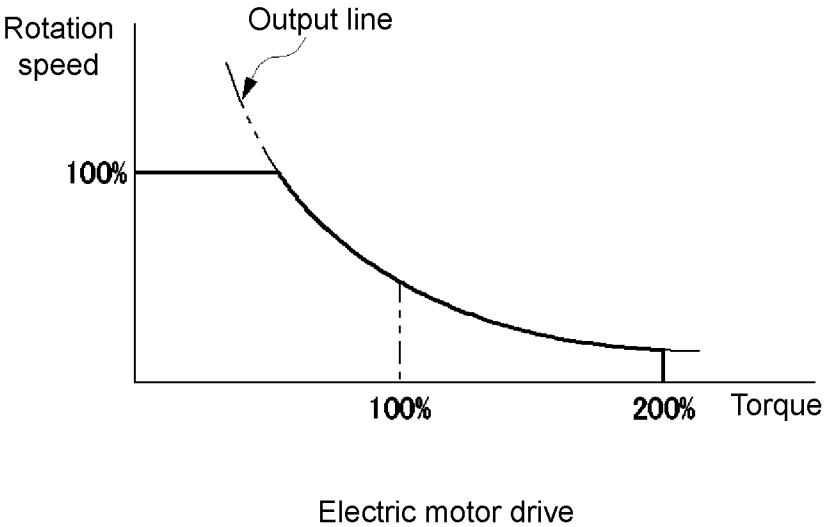

Torque boosting will be described here with reference to FIGS. 6A and 6B. FIGS. 6A and 6B are graphs showing rotational characteristics of hydraulic motors and electric motors, where FIG. 6A shows a rotational characteristic of hydraulic motors and FIG. 6B shows a rotational characteristic of electric motors. As shown in FIG. 6A, hydraulic motors stop rotating when the rotation torque reaches 100%, because the hydraulic relief control causes the flow rate of the hydraulic fluid to be zero. As shown in FIG. 6B, on the other hand, electric motors can rotate at a rotation speed at which the vertical torque line intersects with the output line even when the torque reaches 100% and, furthermore, they can output 100% torque or more using torque boosting. That is to say, if the press-in force of the pile 4 requires to be increased, hydraulic motors could not be torque boosted since the rotation speed would drop before a set torque (100% torque). Electric motors, on the other hand, would be able to be torque boosted without stopping rotating. Therefore, 100% torque (a rated value) or more can be set for electric motors, which is impossible for hydraulic motors.

The integrated control board 50 therefore performs torque boosting to temporarily increase the rotation torque according to the load condition of the electric motors 6, that is, when the electric motors 6 have a margin of load, and thereby allows an efficient construction. Torque boosting is performed only for a short time because it increases the load on the electric motors 6.

The integrated control board 50 controls the rotation output of the electric motors 6 so that it is reduced when the load condition of the electric motors 6 becomes excessive. Whether the load condition is excessive or not may be determined not only by the difference between the actual measured current value and the upper limit current value, but also when the temperature of each electric motor 6 reaches a prescribed value or higher.

The cooling water is supplied to each electric motor 6 evenly at a constant flow rate in a normal control, but the integrated control board 50 may control the cooling capacity of the cooling water depending on the rotation output or the load condition of the electric motors 6. Specifically, the integrated control board 50 outputs a control signal to the electric pump controller 58 so as to increase the flow rate of the coiling water as the rotation output of the electric motors 6 becomes larger or the load condition becomes heavier.

In addition, the integrated control board 50 may determine the load condition to be heavy if the temperature sensor 57 provided on each electric motor 6 detects a temperature of a prescribed value or higher and output a control signal to the electric pump controller 58 so as to increase the flow rate of the cooling water.

Figure 7:
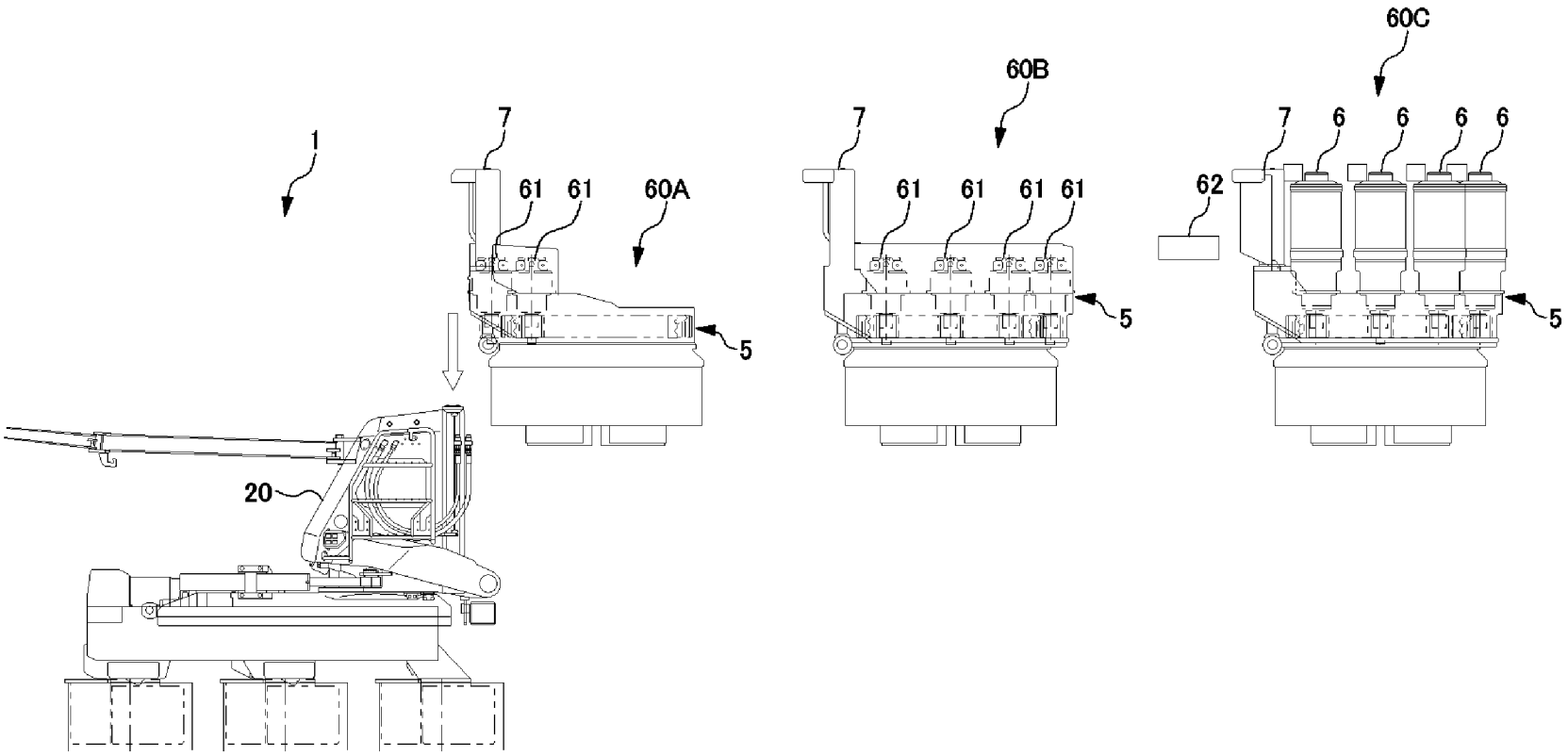
FIG. 7 is a configuration diagram showing the replacement of a chuck in the pile press-in device of the embodiment.

The pile press-in device 1 of the embodiment is configured so that the chuck 5 can be replaced according to ground conditions. FIG. 7 is a configuration diagram showing the replacement of the chuck 5 in the pile press-in device 1 of the embodiment. The pile press-in device 1 of the embodiment is configured so that a unit comprising the lift cylinders 7 and the like as well as the chuck 5 (hereinafter referred to as a "chuck ASSY") can be replaced according to ground conditions.

A chuck ASSY 60A shown in FIG. 7 is of hydraulic standard rotation specifications, where the chuck 5 is rotated by hydraulic motors 61. A chuck ASSY 60B is of hydraulic high-output rotation specifications, where the chuck 5 is rotated at a higher output by using a larger number of hydraulic motors 61 than the chuck ASSY 60A. A chuck ASSY 60C is of electric high-output rotation specifications where the chuck 5 is rotated by the electric motors 6 of the embodiment.

When the chuck ASSY 60A or 60B is used, the hydraulic supply line 53B and the hydraulic motors 61 are connected via the rotation hydraulic control valve 55, and the hydraulic fluid is supplied from the electrohydraulic unit 9 to the hydraulic motors 61.

Mounted on the mast 20 of the chuck ASSY 60B of the hydraulic high-output rotation specifications are the rotation hydraulic control valve 55 that supports the increased hydraulic motors 61, and a box containing a relay control board that relays pieces of information inputted from each of the hydraulic motors 61 and outputs them to the integrated control board 50.

Mounted on the mast 20 of the chuck ASSY 60C of the electric high-output rotation specifications is a tying member 62 that incorporates in a unified manner a hanger for the cooling piping 41 through which the cooling water for cooling the electric motors 6 circulates and a hanger for hydraulic piping through which the hydraulic fluid is supplied to the lift cylinders 7. This allows the tying member 62 to tie the cooling piping 41 and the hydraulic piping together and thereby allows an efficient replacement work even when the chuck ASSY 60C of the electric high-output rotation specifications is used.

While the invention has been described with reference to the above embodiment, the technical scope of the invention is not limited to the scope provided by the embodiment. Various modifications or improvements can be made to the embodiment without departing from the gist of the invention, and those added with the modifications or improvements are also included in the technical scope of the invention.

(Variations)

Figure 8:
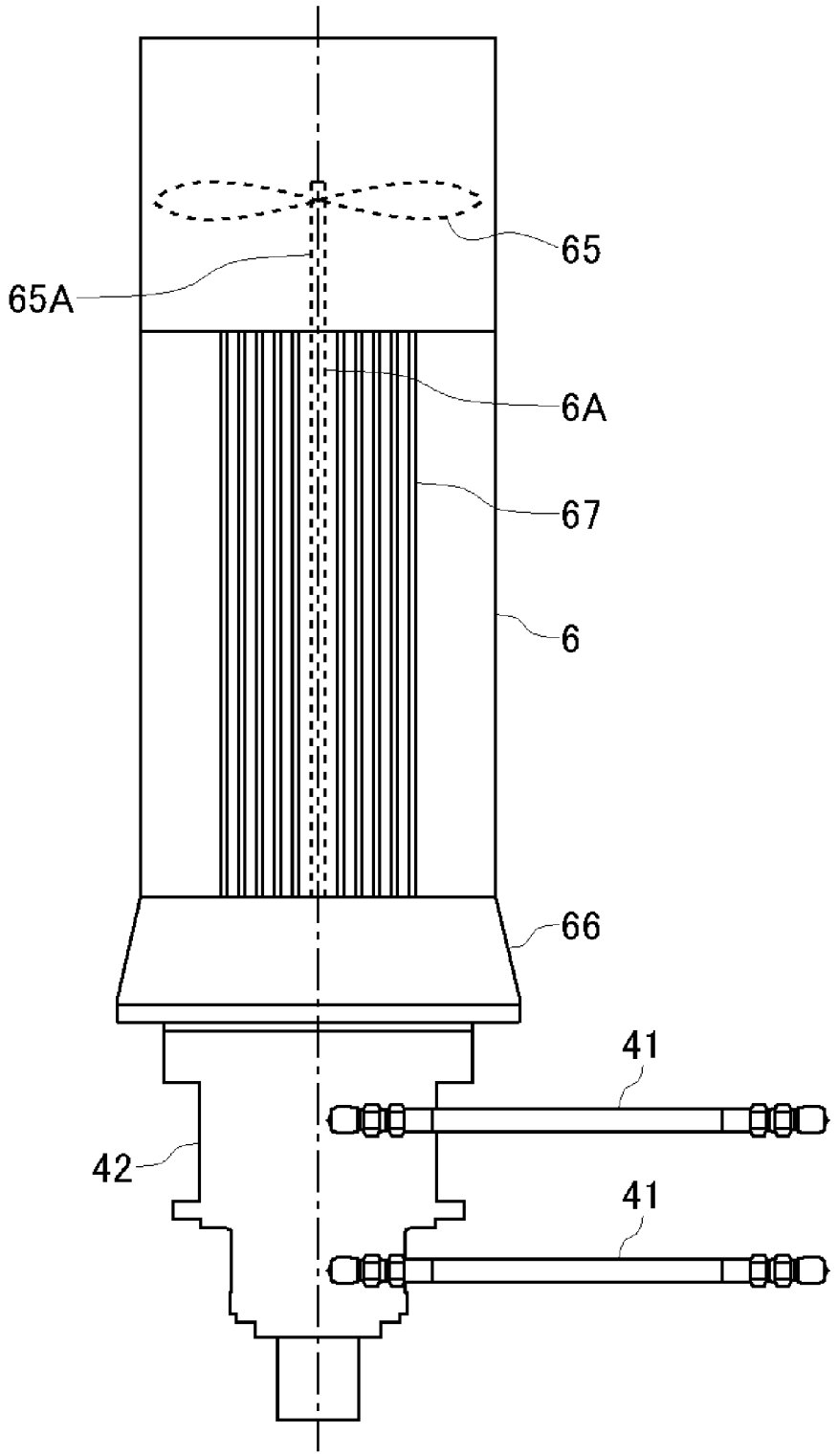
FIG. 8 is a schematic view showing air cooling of the electric motor of a variation.

The cooling device for the electric motors 6 of this variation is of an external fan type. In other words, the electric motors 6 of this variation are cooled by air. FIG. 8 is a schematic configuration diagram of the cooling device for the electric motors 6 of this variation, where the cooling device for the electric motors 6 is a fan 65 provided on each electric motor 6.

In the example of FIG. 8, the fan 65 is provided above the electric motor 6, and a rotating shaft 65A of the fan 65 is directly coupled to the rotating shaft 6A of the electric motor 6. This allows the fan 65 to be driven by the electric motor 6, and therefore allows the electric motor 6 to be cooled with a simple configuration. The electric motor 6 and the speed reducer 42 are coupled via a base 66 in FIG. 8, but this is just an example, and they may be coupled without the base 66.

The variation is configured so that air blown by the fan 65 can cool the electric motor 6 to bottom. In addition, the surface of the electric motor 6 is provided with a plurality of fins 67 along the height direction of the electric motor 6, that is, the air blowing direction. This increases the surface area of the electric motor 6, and therefore enhances the cooling effect of the air cooling. The speed reducer 42 of the variation is installed with the cooling piping 41 and is cooled by the cooling water, but the cooling is not limited to this, and air cooling may be used if the fan 65 has sufficient capacity. The variation uses air cooling to cool the electric motor 6 as seen above, and therefore allows the electrically powered device to be cooled with a simple configuration.

The fan 65 may be provided independently of the rotating shaft 6A of the electric motor 6. If the rotating shaft 65A of the fan 65 is coupled to the rotating shaft 6A of the electric motor 6, it is difficult to control the capacity of the fan 65 since it depends on the rotation speed of the electric motor 6. Therefore, the cooling capacity of the fan 65 is made capable of being controlled independent of the rotation speed of the electric motor 6 by not coupling the rotating shaft 65A of the fan 65 to the rotating shaft 6A of the electric motor 6.

To be specific, the integrated control board 50 controls the cooling capacity of the fan 65 which is independent of the rotating shaft 6A of the electric motor 6 according to the rotation output or the load condition of the electric motor 6. More specifically, the integrated control board 50 controls the rotation speed of a motor for rotating the fan 65 (hereinafter referred to as the "fan drive motor") according to the rotation output or the load condition of the electric motor 6. For example, the integrated control board 50 controls the fan drive motor so that the rotation speed of the fan 65 increases as the rotation output of the electric motor 6 increases or the load condition of the electric motor 6 becomes heavier. This allows the pile press-in system 3 to cool the electric motors 6 efficiently.

DESCRIPTION OF THE SYMBOLS

1: Pile press-in device
5: Chuck (Rotation device)
6: Electric motor (Electrically powered device)
7: Lift cylinder (Hydraulic device)
11: Hydraulic pump (Hydraulic pressure generator)
20: Mast
41: Cooling piping (Cooling device)
42: Speed reducer
50: Integrated control board (Controller)
62: Tying member
65: Fan (Cooling device)

The invention claimed is:

1. A pile press-in device for pressing a pile into a ground while rotating the pile, the pile press-in device comprising:
- a rotation device for gripping and rotating the pile;
- an electric motor that drives the rotation device;
- a hydraulic device as a lift for moving the rotation device up and down; and
- a controller for controlling the electric motor and the hydraulic device in an interlocked manner, wherein the controller:
- controls the up-and-down movement of the rotation device caused by the lift, based on a rotation output of the electric motor at a time of press-in of the pile gripped by the rotation device,
- calculates the rotation output based on an inverter command issued to the electric motor, and temporarily increases a normal torque using inverter control to rotate the pile by monitoring a load condition of the electric motor in real time.

2. The pile press-in device according to claim 1, wherein the controller causes the lift to stop lowering the rotation device when the rotation output of the electric motor reaches a prescribed value.

3. The pile press-in device according to claim 1, wherein the controller controls the rotation output of the electric motor according to the load condition of the electric motor.

4. The pile press-in device according to claim 1, comprising a cooling device for cooling the electric motor.

5. The pile press-in device according to claim 4, wherein the cooling device is a fan directly coupled to a rotating shaft of the electric motor.

6. The pile press-in device according to claim 4, wherein the cooling device is a fan provided independently of a rotating shaft of the electric motor, and wherein the controller controls a cooling capacity of the fan according to the rotation output or the load condition of the electric motor.

7. The pile press-in device according to claim 4, wherein the cooling device is a cooling piping through which coolant circulates, and wherein the coolant cools a speed reducer coupled to a rotating shaft of the electric motor after cooling the electric motor.

8. The pile press-in device according to claim 7, wherein the controller controls a cooling capacity of the coolant according to the rotation output or the load condition of the electric motor.

9. The pile press-in device according to claim 7, comprising a mast for supporting the lift so that the lift can relatively move in a vertical direction, wherein the mast is mounted with a tying member for tying together the cooling piping through which the coolant circulates and hydraulic piping through which a hydraulic fluid is supplied to the hydraulic device.

10. The pile press-in device according to claim 7, wherein the coolant doubles as water to be discharged from a toe of the pile when the pile is pressed into the ground.

11. The pile press-in device according to claim 1, wherein a hydraulic pressure generator for supplying a hydraulic fluid to the hydraulic device is driven by another electric motor.

12. The pile press-in device according to claim 1, wherein the controller:

calculates a torque on a toe of the pile by calculating the rotation output, and obtains ground information in the ground based on a change in the torque.

13. A pile press-in method using a pile press-in device, the pile press-in device comprising:

a rotation device for gripping and rotating a pile;

an electric motor that drives the rotation device; and a hydraulic device as a lift for moving the rotation device up and down, the pile press-in method comprising:

controlling the electric motor and the hydraulic device in an interlocked manner when a pile is pressed into a ground while being rotated;

controlling the up-and-down movement of the rotation device caused by the lift, based on a rotation output of the electric motor at a time of press-in of the pile gripped by the rotation device;

calculating the rotation output based on an inverter command issued to the electric motor; and temporarily increasing a normal torque using inverter control to rotate the pile by monitoring a load condition of the electric motor in real time.

* * * * *